US005417070A

United States Patent [19]

Richardson

[11] Patent Number: 5,417,070

[45] Date of Patent: May 23, 1995

[54] FUEL INJECTION APPARATUS

[75] Inventor: John S. Richardson, Derby, England

[73] Assignee: Rolls-Royce plc, London, England

[21] Appl. No.: 347,105

[22] Filed: Nov. 22, 1994

Related U.S. Application Data

[63] Continuation of Ser. No. 153,958, Nov. 18, 1993, abandoned.

[30] Foreign Application Priority Data

Nov. 24, 1992 [GB] United Kingdom ..... 9224564

[51] Int. Cl.[6] ..... F02C 3/14

[52] U.S. Cl. ..... 60/748; 239/406

[58] Field of Search ..... 60/740, 743, 748; 239/403, 404, 405, 406, 427.3

[56] References Cited

U.S. PATENT DOCUMENTS 3,915,387 10/1975 Caruel et al. ..... 60/748

4,842,197 6/1989 Simon et al. ..... 239/403

5,123,248 6/1992 Monty et al. ..... 60/748

*Primary Examiner*—Timothy S. Thorpe

*Attorney, Agent, or Firm*—Cushman Darby & Cushman

[57] ABSTRACT

A gas turbine engine fuel injection apparatus comprises a fuel spray atomizer which directs a fuel spray onto the radially inner surface of an annular flow deflector. The fuel flows in a film over the flow deflector surface towards an annular lip at the downstream end of the deflector. Swirling air flows are directed over the radially inner and outer surfaces of the flow deflector so as to atomize the fuel as it leaves the annular lip. The fuel is evaporated in the swirling airflows and thoroughly mixed with the airflows in a mixing duct before being discharged into a combustion chamber. The thorough mixing of the evaporated fuel and the airflows prior to combustion results in the production of reduced quantities of the oxide of nitrogen.

8 Claims, 2 Drawing Sheets

FUEL INJECTION APPARATUS

This is a continuation of application Ser. No. 8/153,958, filed on Nov. 18, 1993, which was abandoned upon the filing hereof.

FIELD OF THE INVENTION

This invention relates to fuel injection apparatus and is particularly concerned with fuel injection apparatus for gas turbine engines.

BACKGROUND OF THE INVENTION

The combustion apparatus of a gas turbine engine is required to operate in such a way that the amount of harmful emissions which it produces is minimised. Unfortunately this requirement is often at odds with the requirement that such the combustion apparatus should operate in as efficient manner as possible. Combustion apparatus efficiency improves with increased temperatures within the apparatus. However such increased temperatures give rise to a correspondingly increased rate in the production of the oxides of nitrogen. Such oxides are looked upon as being highly undesirable emissions.

One factor which is significant in the production of the oxides of nitrogen is the efficiency of the atomisation and evaporation of the fuel which is combusted in the combustion apparatus and the thorough mixing of the fuel with the air which is fed into the combustion chamber for combustion purposes. If the fuel is poorly atomised and evaporated so that liquid fuel droplets remain, or if local areas of high fuel concentration occur, the combustion temperature increases. This in turn results in a correspondingly increased rate in the production of the oxides of nitrogen.

SUMMARY OF THE INVENTION

It is an object of the present invention to provide a fuel injection apparatus for the combustion apparatus of a gas turbine engine the use of which results in reduced emissions of the oxides of nitrogen.

According to the present invention, a fuel injection apparatus for use in the combustion apparatus of a gas turbine engine comprises a fuel spray means adapted to spray fuel across a first air flow on to the radially inner surface of a generally annular member downstream of said fuel injection means to form a fuel film flow in a generally downstream direction over said surface, the downstream end of said annular member terminating in an annular lip, means being provided to direct a second air flow over the radially outer surface of said annular member to cooperate with said first air flow to provide atomisation of said fuel film flowing from said downstream annular tip, and a fuel and air mixing duct located radially outwardly of and extending downstream of said annular member to terminate at the upstream end of the combustion chamber of said combustion apparatus, said mixing duct being of sufficient length to provide thorough mixing of air and said fuel prior to their entry into said combustion chamber.

BRIEF DESCRIPTION OF THE DRAWINGS

The present invention will now be described, by way of example, with reference to the accompanying drawings in which.

DETAILED DESCRIPTION OF THE INVENTION

Figure 1:
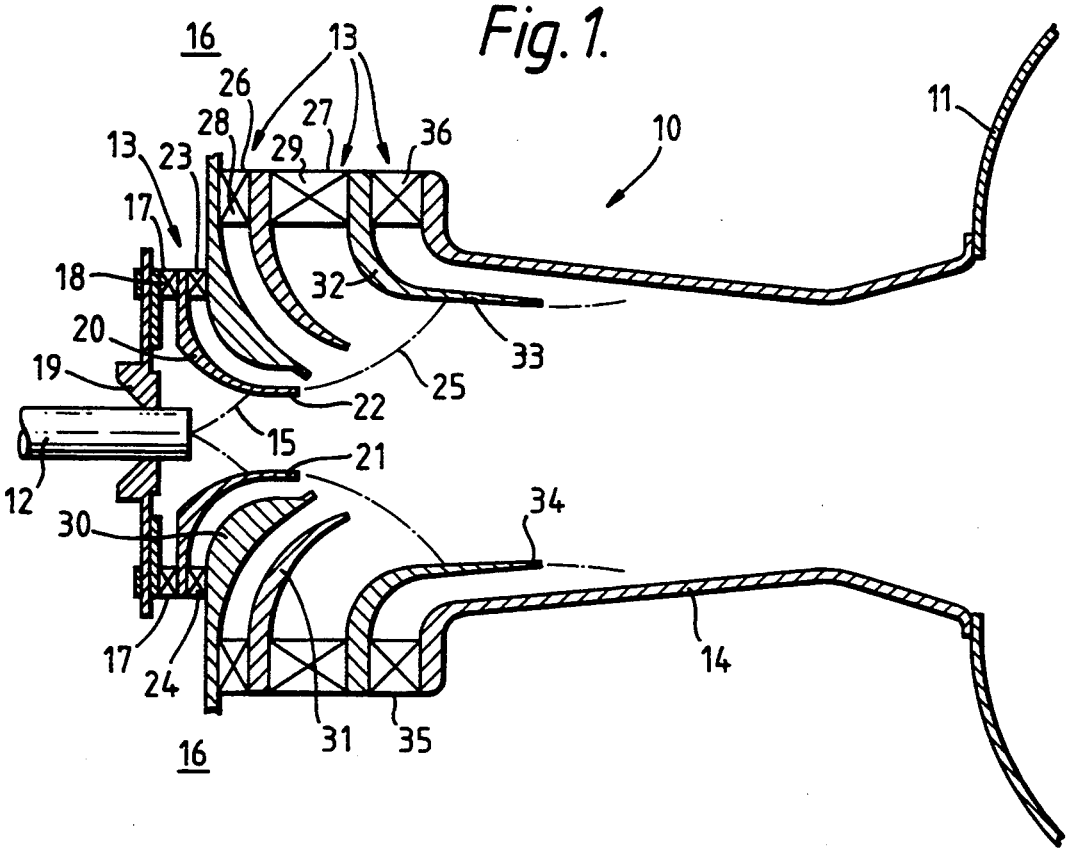
FIG. 1 is a sectioned side view of a fuel injection apparatus in accordance with the present invention.

Referring to FIG. 1, a fuel injection apparatus generally indicated at 10 is attached to the upstream end of a gas turbine engine combustion chamber 11, part of which can be seen in FIG. 1. The actual configuration of the combustion chamber 11 is conventional and will not therefore be described in detail. Suffice to say, however, that the combustion chamber 11 may be of the well known annular type or alternatively of the cannular type so that it is one of an annular array of similar individual combustion chambers or cans. In the case of an cannular combustion chamber, one fuel injection apparatus 10 would normally be provided for each chamber 11. However in the case of an annular combustion chamber 11 the single chamber would be provided with a plurality of the fuel injection apparatus 10 arranged in an annular array at its upstream end. Moreover, more than one annular array could be provided if so desired. For instance there could be two coaxial arrays.

The fuel injection apparatus 10 comprises three major components: a fuel pressure swirl atomiser 12, a plurality of air inlets 13 and a mixing duct 14.

The fuel pressure swirl atomiser 12 is located at the upstream end of the fuel injection apparatus 10. Throughout the specification the terms "upstream" and "downstream" are used with respect to the general direction of flow of liquid and gaseous materials through the fuel injection apparatus 10 and the combustion chamber 11. Thus with regard to the accompanying drawings, the upstream end is towards the left hand side of the drawings and the downstream end is towards the right hand side.

The fuel pressure swirl atomiser 12 receives a supply of pressurised fuel and exhausts that fuel in the form of a generally conical-shaped spray 15 of fuel droplets. The region 16 externally of the fuel injection apparatus 10 contains air at high pressure which has been delivered by the compressor of the gas turbine engine which contains the apparatus 10. Some of that air flows radially inwardly through a first annular air inlet 17 which is located radially outwardly of the fuel pressure swirl atomiser 12. Swirler vanes 18 located in the air inlet 17 impart a swirling motion to the air about the longitudinal axis of the apparatus 10. This swirling flow of air is caused to flow in a generally axial downstream direction by a support plate 19 which carries the atomiser 12 and an annular curved deflector member 20. In doing so, the air flows across the fuel spray 15, thereby evaporating some of the smaller fuel droplets in the spray 15.

The fuel droplets which are not evaporated by the swirling flow of air impinge upon the radially inner surface of the deflector member 20. There they form a film of fuel which proceeds to flow over the deflector member 20 radially inner surface. The downstream portion 21 of the deflector member 20 has parallel walls over which the film of fuel flows in a generally downstream direction until it reaches an annular lip 22 at the downstream end of the deflector member portion 21. There the film of fuel encounters a second flow of swirling air which flows over the radially outer surface of the deflector member 20. The second flow of air originates from a second annular radial air inlet 23 located adjacent the first annular air inlet 17. Swirler vanes 24 in the second air inlet 23 impart the swirling motion to the air flow in the same direction of swirl as that imparted by the swirler vanes 17.

The adjacent swirling air flows over the radially inner and outer surfaces of the deflector member 20 re-atomises the fuel as it flows off the annular lip 22. Additionally the swirling motion of the two adjacent airflows causes the re-atomised fuel to be discharged from the lip 22 in the form of a further conically shaped spray 25. The spray 25 flows across two further swirling air flows which originate from third and fourth adjacent annular radial air inlets 26 and 27 respectively. The air flowing into the inlets 26 and 27 is swirled in the same direction as the air flows through the inlets 17 and 23 by swirler vanes 28 and 29 respectively. The swirled air is then directed in a generally axial direction by further annular deflector members 30 and 31.

The air flowing through the third and fourth inlets 26 and 27 evaporates some of the fuel droplets in the fuel spray 25. The fuel which is not evaporated is deposited upon a further deflector member 32 having a downstream portion 33 which has slightly convergent walls although in certain circumstances they could be parallel. The deposited fuel flows in the form of a film over the downstream portion 33 until it reaches an annular lip 34 at the downstream end of the portion 33. There the film of fuel encounters a further flow of swirling air which flows over the radially outer surface of the further deflector member 32. This further flow of air originates from a fifth annular radial air inlet 35 which is located adjacent the fourth air inlet 27. Swirler vanes 36 in the fifth air inlet 35 swirl the air flow in the same direction as the air swirled by the remaining swirl vanes 17, 24, 28 and 29.

The swirling air flowing over the radially inner and outer surfaces of the further deflector member 32 re-atomises the fuel as it flows from the annular lip 34 in a similar manner to the re-atomising of the fuel flowing from the annular lip 22 of the first deflector member 20. However, at this position, there is a sufficiently small amount of fuel that the atomised fuel leaving the annular lip 34 is quickly evaporated by the air flowing around it. This ensures that no liquid fuel is deposited on the radially inner wall of the mixing duct 14. Consequently substantially all of the fuel which then flows through the mixing duct 14 has been evaporated by the various air flows from the air inlets 13.

The mixing duct 14 is located radially outwardly of and extends downstream the further deflector member 32. It is of generally convergent-divergent configuration. Additionally it is of sufficient length to ensure that the evaporated fuel, and the swirling air flows which carry it, are thoroughly mixed by the time they reach the downstream end of the duct 14. Consequently the fuel/air mixture which is subsequently delivered into the combustion chamber 11 does not contain significant localised high concentrations of fuel, either in the form of vapour or droplets. This ensures that local areas of high temperature within the combustion chamber 11 are avoided, so in turn reducing the production of the oxides of nitrogen.

Additionally, since no liquid fuel is deposited upon the radially inner wall of the mixing duct 14, fuel cannot flow along that wall and into the combustion chamber 11 to create local areas of high temperature.

The provision of the various deflector members 20, 30, 31 and 32 ensures that the air flow through the fuel injection apparatus 10 is smooth with the avoidance of wakes around the atomiser 12. This in turn ensures that combustion flashback into the apparatus 10 is avoided. Such a flashback would result in combustion taking place in the vicinity of liquid fuel droplets, thereby increasing temperatures and the undesirable production of the oxides of nitrogen.

Figure 2:
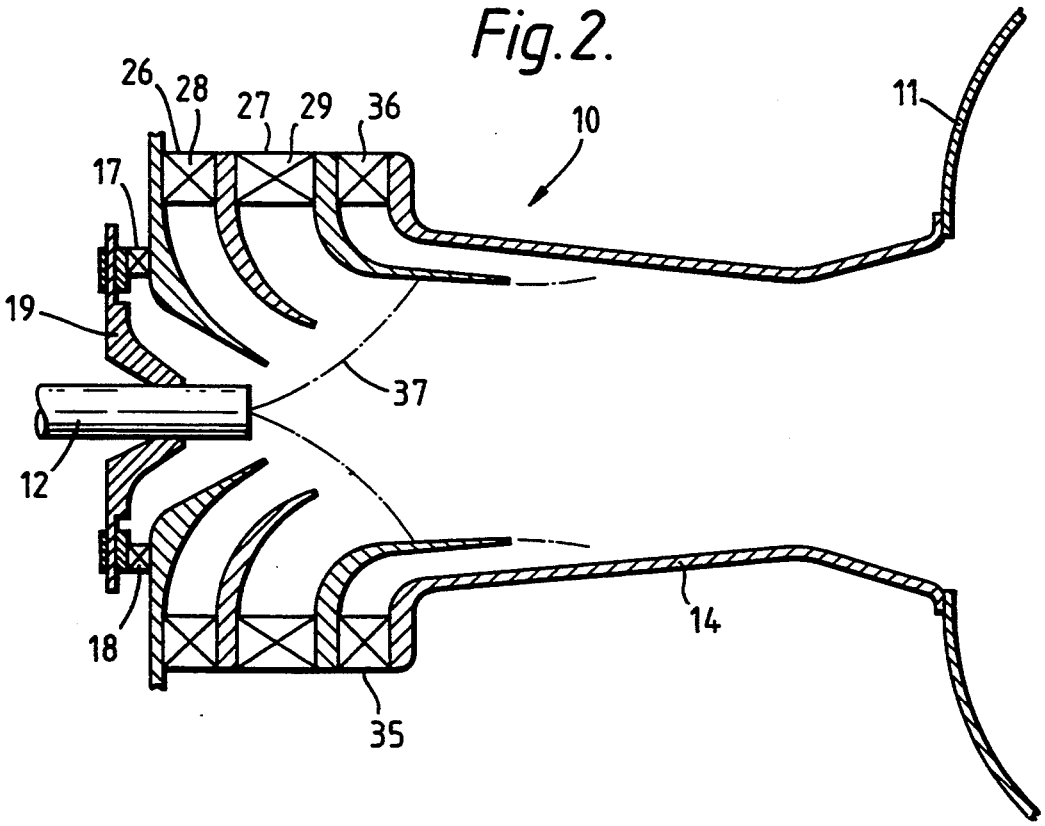
FIG. 2 is a sectioned side view of an alternative embodiment of a fuel injection apparatus in accordance with the present invention.
Figure 3:
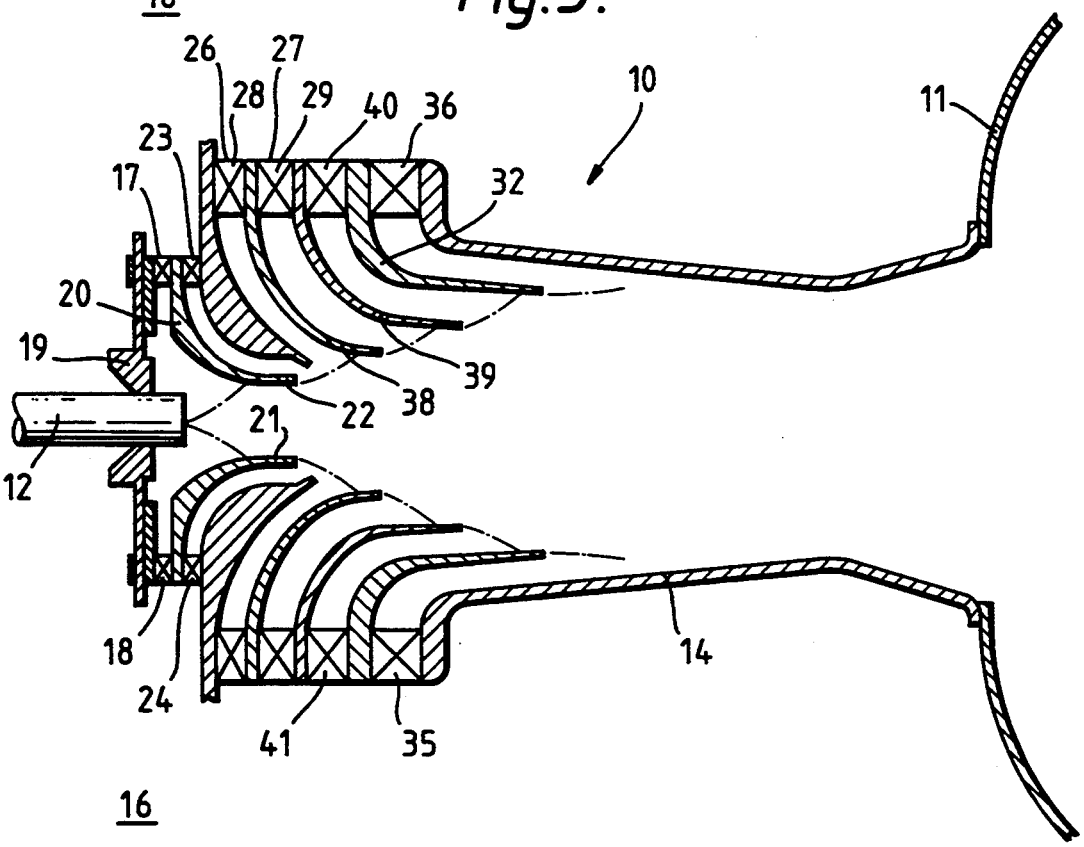
FIG. 3 is a sectioned side view of a further alternative embodiment of a fuel injection apparatus in accordance with the present invention.

The embodiments of the present invention which are shown in FIGS. 2 and 3 are Generally similar to that shown in FIG. 1 and consequently like components share the same reference numerals.

In the embodiment of FIG. 2, only one deflector member 32 is provided to receive the fuel spray 37 from the fuel pressure swirl atomiser 12. The deflector member 32 is the most downstream of the deflector members. Consequently the fuel spray 37 is exposed to several swirling flows of air before it is finally deposited upon the radially inner surface of the deflector member 32. As a result, a large proportion of that fuel spray 37 is evaporated prior to its deposition upon the deflector member 32. That fuel which does reach the deflector member 32 is fully vaporised as it flows off the annular lip 33 at the downstream end of the deflector member 34.

In the embodiment of FIG. 3, extended deflector member 38 and 39 are provided to define additional surfaces 40 and 41 respectively to receive sprayed fuel and subsequently vaporise that fuel from an annular lip. Additionally a further annular air inlet 40 is provided between the air inlets 27 and 35 which is provided with swirler vanes 41.

It will be appreciated that the number and position of the deflector members which received sprayed fuel and subsequently re-atomise that fuel will depend on the particular characteristics of the combustion equipment they are applied to. Essentially sufficient deflector members are chosen to ensure that substantially all of the fuel initially sprayed from the fuel pressure swirl atomiser 12 is vaporised by the time it enters the combustion chamber 11.

It will also be appreciated that although in the case of the present invention, all of the air entering the fuel injection equipment 10 is swirled in the same direction, this need not necessarily always be necessary. Thus some of the air could be swirled in one direction whilst the remainder is swirled in the opposite direction. Alternatively some of the air need not be swirled at all.

I claim:

1. A fuel injection apparatus for use in the combustion apparatus of a gas turbine engine comprising a fuel spray means adapted to spray fuel across a first air flow on to the radially inner surface of a generally annular member downstream of said fuel injection means to form a fuel film flow in a generally downstream direction over said surface, the downstream end of said annular member terminating in an annular lip, means being provided to direct a second air flow over the radially outer surface of said annular member to cooperate with said first air flow to provide atomization of said fuel film flowing from said downstream annular lip, and a fuel and air mixing duct located radially outwardly of and extending downstream of said annular member to terminate at the upstream end of the combustion chamber of said combustion apparatus, said mixing duct being of sufficient length to provide mixing of air and said fuel prior to their entry into said combustion chamber, said mixing duct having a first convergent portion extending from said downstream annular lip and a second diverging portion having an end leading to said combustion chamber, said converging and diverging portions being both located downstream of said downstream annular lip.

2. A fuel injection apparatus as claimed in claim 1 wherein said first and second air flows are initially directed into said apparatus in a radially inward direction, said generally annular member being so configured as to subsequently direct said air in a generally axial direction prior to said air flowing over said downstream annular lip.

3. A fuel injection apparatus as claimed in claim 2 wherein said apparatus is provided with a plurality of said generally annular members, at least some of said annular members being so positioned and configured as to not directly receive said sprayed fuel.

4. A fuel injection apparatus as claimed in claim 3 wherein a plurality of air inlets are provided to direct air into the interior of said apparatus, one air inlet being located between adjacent of said annular members.

5. A fuel injection apparatus as claimed in any one preceding claim wherein swirling means are provided to swirl said air flows into said apparatus.

6. A fuel injection apparatus as claimed in claim 5 wherein all of said air flows are swirled in the same direction.

7. A fuel injection apparatus as claimed in claim 1 wherein the portion of said generally annular member over which said fuel film flows has generally parallel walls.

8. A fuel injection apparatus for use in the combustion apparatus including a combustion chamber of a gas turbine engine comprising a fuel spray means adapted to spray fuel across a first air flow onto the radially inner surface of a generally annular member downstream of said fuel injection means to form a fuel film flow in a generally downstream direction over said surface, the downstream end of said annular member terminating in an annular lip, means being provided to direct a second air flow over the radially outer surface of said annular member to cooperate with said first air flow to provide atomization of said fuel film flowing from said downstream annular lip, and a fuel and air mixing duct located radially outwardly of and extending downstream of said annular member and including a converging portion followed by a diverging portion terminating at the upstream end of the combustion chamber of said combustion apparatus, said mixing duct being of sufficient length to provide mixing of air and said fuel prior to their entry into said combustion chamber, both said converging and diverging portions of said mixing duct being located downstream of said downstream annular lip.

* * * * *